US011920874B2

(12) United States Patent
Kimura et al.

(10) Patent No.: US 11,920,874 B2
(45) Date of Patent: Mar. 5, 2024

(54) HEAT EXCHANGE MEMBER, HEAT EXCHANGER AND HEAT CONDUCTIVE MEMBER

(71) Applicant: NGK INSULATORS, LTD., Nagoya (JP)

(72) Inventors: Daisuke Kimura, Nagoya (JP); Tatsuo Kawaguchi, Mizuho (JP)

(73) Assignee: NGK INSULATORS, LTD., Nagoya (JP)

( * ) Notice: Subject to any disclaimer, the term of this patent is extended or adjusted under 35 U.S.C. 154(b) by 0 days.

(21) Appl. No.: 17/453,021

(22) Filed: Nov. 1, 2021

(65) Prior Publication Data

US 2022/0252353 A1 Aug. 11, 2022

(30) Foreign Application Priority Data

Feb. 9, 2021 (JP) ..... 2021-019322
Sep. 14, 2021 (JP) ..... 2021-149704

(51) Int. Cl.
*F28D 7/10* (2006.01)
*F28D 7/12* (2006.01)
*F28F 1/02* (2006.01)
*F28F 1/40* (2006.01)

(52) U.S. Cl.
CPC ..... *F28D 7/106* (2013.01); *F28D 7/12* (2013.01); *F28F 1/022* (2013.01); *F28F 1/40* (2013.01)

(58) Field of Classification Search
CPC .. F28D 7/106; F28D 7/12; F28F 1/022; F28F 1/40
USPC ..... 165/154
See application file for complete search history.

(56) References Cited

U.S. PATENT DOCUMENTS 813,918 A * 2/1906 Schmitz ..... F28D 7/103 428/596
1,734,274 A * 11/1929 Schubart ..... F28F 3/086 165/DIG. 360
2,360,739 A * 10/1944 Strom ..... F28D 9/04 165/165

(Continued)

FOREIGN PATENT DOCUMENTS

DE 10 2019 200 040 A1 7/2019
JP 2020-067020 A 4/2020
WO 2019/135312 A1 7/2019

OTHER PUBLICATIONS

German Office Action (with English translation) dated Mar. 22, 2023 (Application No. 10 2021 213 025.9).

*Primary Examiner* — Tho V Duong
*Assistant Examiner* — Raheena R Malik
(74) *Attorney, Agent, or Firm* — BURR PATENT LAW, PLLC

(57) ABSTRACT

A heat exchange member includes: a honeycomb structure including: an outer peripheral wall; an inner peripheral wall; and partition walls arranged between the outer peripheral wall and the inner peripheral wall, the partition walls defining a plurality of cells, each of the cells extending from a first end face to a second end face to form a flow path for a first fluid; and a covering member for covering an outer peripheral surface of the outer peripheral wall. In a cross section of the honeycomb structure orthogonal to a flow path direction for the first fluid, the partition walls extend in a radial direction. Each of the cells is formed from the outer peripheral wall, the inner peripheral wall, and the partition walls.

9 Claims, 8 Drawing Sheets

(56) References Cited

U.S. PATENT DOCUMENTS 2,386,746 A * 10/1945 Hess ..... B64D 13/08 431/258
2,399,357 A * 4/1946 Koper ..... F28D 1/024 165/122
2,693,026 A * 11/1954 Simpelaar ..... F28F 1/14 29/523
2,703,921 A * 3/1955 Brown, Jr. ..... F28D 7/106 29/890.036
3,372,741 A * 3/1968 Kaiser ..... H01J 19/36 165/185
3,803,951 A * 4/1974 Bagley ..... B29C 48/335 29/445
3,825,063 A * 7/1974 Cowans ..... F28F 21/06 165/146
3,828,851 A * 8/1974 Takayasu ..... F28D 9/0012 165/165
3,837,783 A * 9/1974 Bagley ..... B29C 48/335 425/464
4,233,812 A * 11/1980 Leistritz ..... F01N 1/02 165/142
4,340,501 A * 7/1982 Davidson ..... C01B 3/384 428/116
4,343,354 A * 8/1982 Weber ..... F28F 7/02 165/DIG. 395
4,363,644 A * 12/1982 Sato ..... C04B 38/00 428/117
4,368,777 A * 1/1983 Grasso ..... F28D 7/106 165/146
4,373,577 A * 2/1983 McMillen ..... F28F 1/32 165/122
4,657,074 A * 4/1987 Tomita ..... F28F 1/422 165/DIG. 520
4,715,438 A * 12/1987 Gabuzda ..... H01L 23/467 257/713
4,877,396 A * 10/1989 Wunning ..... F23D 14/66 431/166
4,877,670 A * 10/1989 Hamanaka ..... C04B 38/0006 428/116
4,878,536 A * 11/1989 Stenlund ..... F28F 19/01 123/196 AB
4,964,459 A * 10/1990 Stenlund ..... F28D 7/106 184/104.1
5,172,752 A * 12/1992 Goetz, Jr. ..... F28D 1/05383 165/41
5,228,513 A * 7/1993 Hemsath ..... F28D 7/106 165/154
5,593,646 A * 1/1997 Koshiba ..... F01N 3/281 422/177
5,633,066 A * 5/1997 Lipp ..... B29C 48/11 502/527.22
5,882,461 A * 3/1999 Rogut ..... B01D 63/02 156/182
6,098,704 A * 8/2000 Tsuchiya ..... F28D 7/106 165/154
6,157,778 A * 12/2000 Kadotani ..... F24H 1/142 392/483
6,233,824 B1 * 5/2001 Dobbs ..... F28D 9/04 165/165
6,374,598 B1 * 4/2002 Neuschwander ..... F28F 1/422 165/154
6,419,009 B1 * 7/2002 Gregory ..... F28D 1/053 165/146
6,471,392 B1 * 10/2002 Holl ..... B01J 19/10 366/279
6,948,555 B1 * 9/2005 Garcia ..... F28F 1/422 174/16.3
7,278,472 B2 * 10/2007 Meshenky ..... F04D 29/5826 165/125
7,575,793 B2 * 8/2009 Aniolek ..... C04B 35/565 428/116
8,257,460 B2 * 9/2012 Komori ..... B01D 46/2484 428/116
8,646,484 B2 * 2/2014 Stroganov ..... F15B 1/24 138/31
9,534,856 B2 * 1/2017 Suzuki ..... F28D 7/10
10,775,106 B2 * 9/2020 Czyz ..... F25B 40/00
11,117,083 B2 * 9/2021 Beall ..... B01D 46/2492
2005/0056408 A1 * 3/2005 Gregory ..... F28F 1/40 165/151
2005/0109493 A1 * 5/2005 Wu ..... F02B 29/0462 165/157
2007/0012426 A1 * 1/2007 Rago ..... F28D 7/106 165/92
2007/0230183 A1 * 10/2007 Shuy ..... H05K 7/20009 362/547
2007/0231533 A1 * 10/2007 Aniolek ..... C04B 35/478 428/116
2009/0014163 A1 * 1/2009 Thomas ..... F16L 53/32 165/154
2009/0041635 A1 * 2/2009 Berkey ..... F01N 3/0222 422/177
2009/0260792 A1 * 10/2009 Yalin ..... F28F 1/36 165/181
2011/0214847 A1 * 9/2011 Hur ..... F28D 7/106 165/143
2012/0199326 A1 * 8/2012 Sheldon ..... F25B 40/00 165/154
2012/0247732 A1 * 10/2012 Suzuki ..... F28D 7/10 165/104.14
2014/0090818 A1 * 4/2014 Rosenfeld ..... F28F 13/12 165/109.1
2014/0182828 A1 * 7/2014 Lekhin ..... F28F 1/42 165/179
2015/0292812 A1 * 10/2015 Tomita ..... F28F 1/40 165/177
2019/0204031 A1 * 7/2019 Kawaguchi ..... F28F 13/06
2019/0277570 A1 * 9/2019 Kawaguchi ..... F28D 7/10
2020/0123956 A1 4/2020 Miyairi et al.
2022/0252353 A1 * 8/2022 Kimura ..... F28F 1/40
2022/0390180 A1 * 12/2022 Kuno ..... F28F 21/04

* cited by examiner

HEAT EXCHANGE MEMBER, HEAT EXCHANGER AND HEAT CONDUCTIVE MEMBER

FIELD OF THE INVENTION

The present invention relates to a heat exchange member, a heat exchanger and a heat conductive member.

BACKGROUND OF THE INVENTION

Recently, there is a need for improvement of fuel economy of motor vehicles. In particular, a system is expected that worms up a coolant, engine oil and an automatic transmission fluid (ATF: Automatic Transmission Fluid) at an early stage to reduce friction losses, in order to prevent deterioration of fuel economy at the time when an engine is cold, such as when the engine is started. Further, a system is expected that heats an exhaust gas purifying catalyst in order to activate the catalyst at an early stage.

As the above system, for example, there is a heat exchanger. The heat exchanger is a device that exchanges heat between a first fluid and a second fluid by allowing the first fluid to flow inside and the second fluid to flow outside. In such a heat exchanger, for example, the heat can be effectively utilized by exchanging the heat from the first fluid having a higher temperature (for example, an exhaust gas) to the second fluid having a lower temperature (for example, cooling water).

A heat exchanger that uses a heat exchange member having a honeycomb structure has been proposed as the heat exchanger for recovering heat from high-temperature gases such as exhaust gases from motor vehicles. A heat exchanger member having a hollow honeycomb structure including a hollow region that functions as a bypass route for an exhaust gas has also been proposed.

For example, Patent Literature 1 proposes a heat exchange member including: a hollow-type honeycomb structure having partition walls defining cells each penetrating from a first end face to a second end face to form a flow path for a first fluid, an inner peripheral wall, and an outer peripheral wall; and a covering member for covering the outer peripheral wall of the honeycomb structure, wherein in a cross section of the honeycomb structure orthogonal to a flow path direction for the first fluid, the cells are radially provided, and the inner peripheral wall and the outer peripheral wall have thicknesses greater than those of the partition walls.

CITATION LIST

Patent Literature

[Patent Literature 1] WO 2019/135312 A1

SUMMARY OF THE INVENTION

The present invention is specified as follows:

The present invention relates to a heat exchange member, comprising:

a honeycomb structure comprising: an outer peripheral wall; an inner peripheral wall; and partition walls arranged between the outer peripheral wall and the inner peripheral wall, the partition walls defining a plurality of cells, each of the cells extending from a first end face to a second end face to form a flow path for a first fluid; and a covering member for covering an outer peripheral surface of the outer peripheral wall, wherein in a cross section of the honeycomb structure orthogonal to a flow path direction for the first fluid, the partition walls extend in a radial direction, and wherein each of the cells is formed from the outer peripheral wall, the inner peripheral wall, and the partition walls.

The present invention also relates to a heat exchange member, comprising:

a honeycomb structure comprising: an outer peripheral wall; an inner peripheral wall; and partition walls arranged between the outer peripheral wall and the inner peripheral wall, the partition walls defining a plurality of cells, each of the cells extending from a first end face to a second end face to form a flow path for a first fluid; and a covering member for covering an outer peripheral surface of the outer peripheral wall, wherein in a cross section of the honeycomb structure orthogonal to a flow path direction for the first fluid, the partition walls comprise partition walls extending in a radial direction, and a ratio of the number of partition walls extending in the radial direction to an outer diameter (mm) of the honeycomb structure is 3.2 partition walls/mm or more.

The present invention also relates to a heat exchanger, comprising:

the heat exchange member; and an outer cylinder arranged at an interval on a radially outer side of the covering member so that a second fluid can circulate around an outer periphery of the covering member.

The present invention also relates to a heat conductive member, comprising a honeycomb structure comprising: an outer peripheral wall; an inner peripheral wall; and partition walls arranged between the outer peripheral wall and the inner peripheral wall, the partition walls defining a plurality of cells, each of the cells extending from a first end face to a second end face to form a flow path for a first fluid, wherein the outer peripheral wall, the inner peripheral wall, and the partition walls comprise a Si—SiC material based on SiC particles as an aggregate, wherein a metal Si is contained between the SiC particles, wherein in a cross section of the honeycomb structure orthogonal to a flow path direction for the first fluid, the partition walls extend in a radial direction, and wherein each of the cells is formed from the outer peripheral wall, the inner peripheral wall, and the partition walls.

The present invention also relates to a heat conductive member, comprising a honeycomb structure comprising: an outer peripheral wall; an inner peripheral wall; and partition walls arranged between the outer peripheral wall and the inner peripheral wall, the partition walls defining a plurality of cells, each of the cells extending from a first end face to a second end face to form a flow path for a first fluid, wherein the outer peripheral wall, the inner peripheral wall, and the partition walls comprise a Si—SiC material based on SiC particles as an aggregate, wherein a metal Si is contained between the SiC particles, and wherein in a cross section of the honeycomb structure orthogonal to a flow path direction for the first fluid, the partition walls comprise partition walls extending in a radial direction, and a ratio of the number of partition walls extending in the radial direction to an outer diameter (mm) of the honeycomb structure is 3.2 partition walls/mm or more.

DETAILED DESCRIPTION OF THE INVENTION

Figure 1:
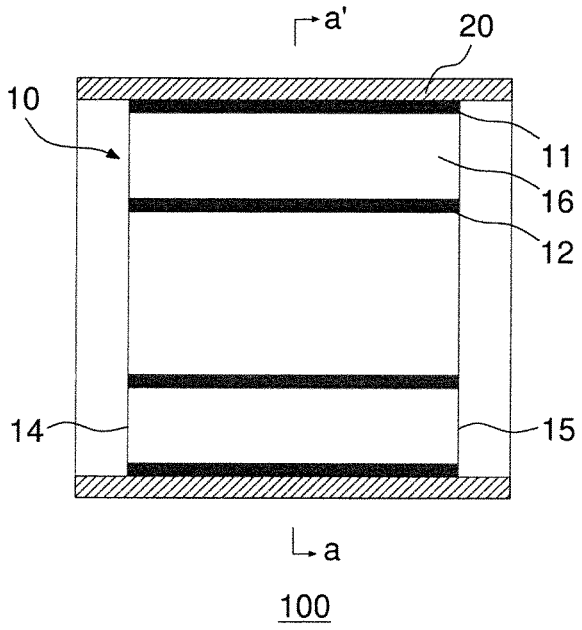
FIG. 1 is a cross-sectional view of a heat exchange member according to Embodiment 1 of the present invention, which is parallel to an axial direction of a honeycomb structure.

As a result of studies, the present inventors have found that the heat exchange member described in Patent Literature 1 has still room for improvement in achieving both an increase in a heat recovery efficiency and suppression of an increase in pressure loss.

The present invention has been made to solve the above problems. An object of the present invention is to provide a heat exchange member and a heat exchanger which can achieve both an increase in a heat recovery efficiency and suppression of an increase in pressure loss. The present invention also provides a heat conductive member that can be mounted on the heat exchange member and the heat exchanger as described above.

According to the present invention, it is possible to provide a heat exchange member and a heat exchanger which can achieve both an increase in a heat recovery efficiency and suppression of an increase in pressure loss. Also, according to the present invention, it is possible to provide a heat conductive member that can be mounted on the heat exchange member and the heat exchanger as described above.

Hereinafter, embodiments of the present invention will be specifically described with reference to the drawings. It is to understand that the present invention is not limited to the following embodiments, and those which appropriately added changes, improvements and the like to the following embodiments based on knowledge of a person skilled in the art without departing from the spirit of the present invention fall within the scope of the present invention.

The present inventors have studied for the problem of further improving the heat recovery efficiency in Patent Literature 1, and found the following matters. The hollow-type honeycomb structure described in Patent Literature 1 has the partition walls including: second partition walls extending in the circumferential direction; and first partition walls intersecting with the second partition walls, in a cross section of the honeycomb structure orthogonal to the flow path direction for the first fluid. It has been found that the first partition walls have a role of transferring the heat of the first fluid flowing through the cells to the outer peripheral surface of the honeycomb structure to facilitate smooth heat exchange between the first fluid and the second fluid circulating outside the covering material that covers the outer peripheral surface, but the second partition walls do not contribute so much to the above role and they are a factor for increasing the pressure loss. Further, the larger number of the second partition walls decrease opening areas of the cells, which will increase the flow rate of the first fluid through the cells. It has also been found that, as a result, the first fluid passes through the honeycomb structure before the heat of the first fluid is sufficiently recovered, which may reduce the heat recovery efficiency, and there is room for improvement.

Embodiment 1

(1) Heat Exchange Member and Heat Conductive Member

Figure 2:
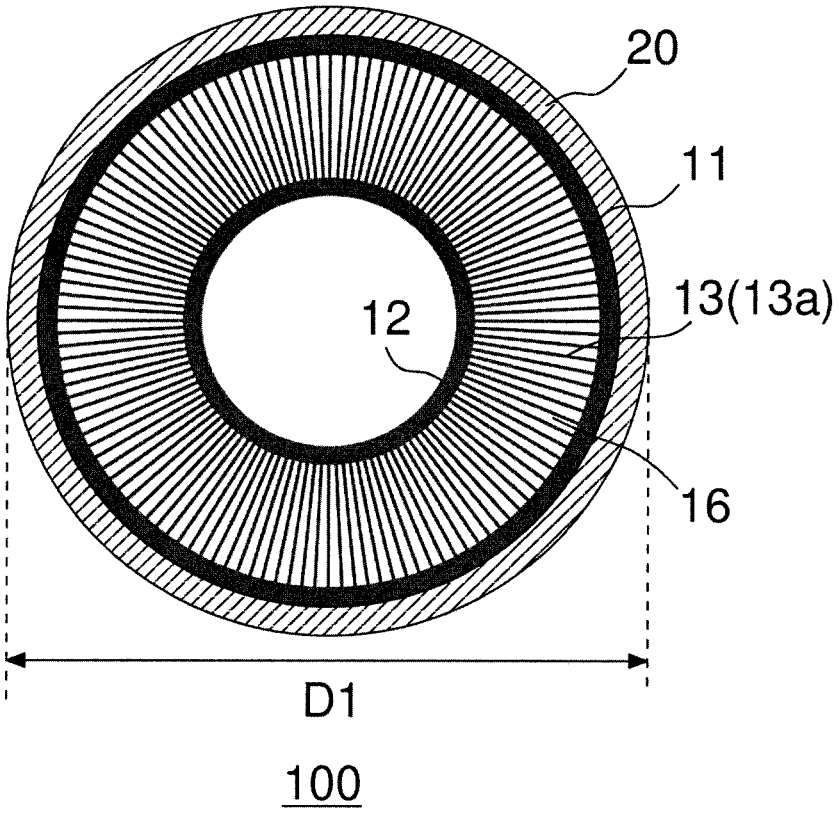
FIG. 2 is a cross-sectional view taken along the line a-a' in the heat exchange member shown in FIG. 1.
Figure 3:
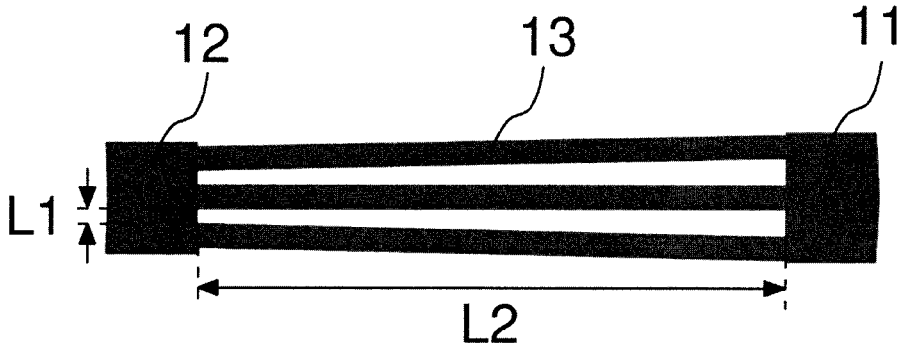
FIG. 3 is a partially enlarged view of a honeycomb structure forming the heat exchange member shown in FIG. 2.

FIG. 1 is a cross-sectional view of a heat exchange member according to Embodiment 1 of the present invention, which is parallel to an axial direction of a honeycomb structure. FIG. 2 is a cross-sectional view taken along the line a-a' in the heat exchange member shown in FIG. 1 that is, a cross sectional view of the heat exchanger member according to Embodiment 1 of the present invention orthogonal to the flow path direction (axial direction) for the first fluid of the honeycomb structure. FIG. 3 is a partially enlarged view of the honeycomb structure forming the heat exchange member shown in FIG. 2.

A heat exchange member 100 according to Embodiment 1 of the present invention includes: a honeycomb structure 10 including: an outer peripheral wall 11; an inner peripheral wall 12; and partition walls 13 arranged between the outer peripheral wall 11 and the inner peripheral wall 12, the partition walls 13 defining a plurality of cells 16 each extending from a first end face 14 to a second end face 15 to form a flow path for a first fluid; and a covering member 20 for covering an outer peripheral surface of the outer peripheral wall 11. In the heat exchange member 100 having such a structure, heat exchange between the first fluid that can flow though the cells 16 and a second fluid that can flow over an outer periphery of the covering member 20 is performed via the outer peripheral wall 11 of the honeycomb structure 10 and the covering member 20. It should be noted that in FIG. 1, the first fluid can flow in both right and left directions on a page surface of FIG. 1. The first fluid is not particularly limited, and various liquids or gases may be used. For example, when the heat exchange member 100 is used for a heat exchanger mounted on a motor vehicle, the first fluid is preferably an exhaust gas.

Among members of the heat exchange member 100 according to Embodiment 1 of the present invention, the member excluding the covering member 20 is referred to as a heat conductive member. In other words, the heat conductive member according to Embodiment 1 of the present invention has the honeycomb structure 10 including: the outer peripheral wall 11; the inner peripheral wall 12; and the partition walls 13 arranged between the outer peripheral wall 11 and the inner peripheral wall 12, the partition walls 13 defining the plurality of cells 16 each extending from the first end face 14 to the second end face 15 to form the flow path for the first fluid.

The partition walls 13 (13*a*) that form the honeycomb structure 10 extend in the radial direction in the cross section of the honeycomb structure 10 orthogonal to the flow path direction for the first fluid (i.e., the cross section as shown in FIG. 2). Such a structure can allow the heat of the first fluid to be transferred in the radial direction through the partition walls 13*a*, so that the heat of the first fluid can be efficiently transferred to the outside of the honeycomb structure 10.

Each of the plurality of cells 16 that serves as the flow path for the first fluid is formed from the outer peripheral wall 11, the inner peripheral wall 12, and the partition walls 13*a* extending in the radial direction. In other words, the plurality of cells 16 do not have the partition walls 13 extending in the radial direction, in the cross section of the honeycomb structure 10 orthogonal to the flow path direction for the first fluid. The partition walls 13 extending in the circumferential direction do not contribute so much to the heat exchange between the first fluid and the second fluid as described above, and are also a factor for increasing the pressure loss. Further, an increased number of the partition walls 13 extending in the circumferential direction decreases the opening areas of the cells 16, which will increase the flow rate of the first fluid flowing through the cells 16. As a result, the first fluid passes through the honeycomb structure 10 before the heat of the first fluid is sufficiently recovered, resulting in a decrease in heat recovery efficiency. Therefore, by forming each of the plurality of cells 16 from the outer peripheral wall 11, the inner peripheral wall 12, and the partition walls 13*a* in the radial direction, it is possible to achieve both improvement of the heat recovery efficiency and suppression of the increase in pressure loss.

The number of the partition walls 13*a* extending in the radial direction can be set according to the size of the honeycomb structure 10, as needed.

For example, in the cross section of the honeycomb structure 10 orthogonal to the flow path direction for the first fluid, it is preferable that a ratio (N/D1) of the number (N) of the partition walls 13 to an outer diameter D1 (mm) of the honeycomb structure 10 is 2.3 partition walls/mm or more, and more preferably 3.2 partition walls/mm or more, and even more preferably 4 partition walls/mm or more. This configuration can achieve both improvement of heat recovery efficiency and suppression of increase in pressure loss, while ensuring the mechanical strength of the honeycomb structure 10.

The upper limit of the ratio (N/D1) may generally be 6 partition walls/mm or less, although not particularly limited thereto.

In the cross section of the honeycomb structure 10 orthogonal to the flow path direction for the first fluid, an aspect ratio of each cell 16 may preferably be 3 or more, and more preferably 5 or more, although not particularly limited. The controlling of the aspect ratio in such a range can stably achieve both improvement of heat recovery efficiency and suppression of increase in pressure loss.

As used herein, the aspect ratio of each cell 16 refers to a ratio (L2/L1) of a length L2 of the partition wall 13 (13*a*) to a length L1 of the inner peripheral wall 12, which form one cell 16.

The upper limit of the aspect ratio of each cell 16 may generally be 30 or less.

In a typical embodiment, the number of the partition walls 13*a* in the radial direction is from 200 to 500, and preferably from 300 to 500, although not particularly limited. The length L2 of the partition wall 13*a* in the radial direction is from 1.7 to 20 mm. The length L1 of the inner peripheral wall 12 forming one cell 16 is from 0.1 to 2 mm. Such a structure can achieve both improvement of the heat recovery efficiency and suppression of the increase in pressure loss.

A shape (an outer shape) of the pillar shaped honeycomb structure 10 may be, but not limited to, for example, a circular pillar shape, an elliptic pillar shape, a quadrangular pillar shape or other polygonal pillar shape. Thus, the outer shape of the honeycomb structure 10 (i.e., the outer shape of the outer peripheral wall 11) in the cross section in FIG. 2 may be circular, elliptical, quadrangular or other polygonal.

Also, a shape of a hollow region in the honeycomb structure 10 may be, but not limited to, for example, a circular pillar shape, an elliptic pillar shape, a quadrangular pillar shape or other polygonal pillar shape. Thus, the shape of the hollow region (i.e., the inner shape of the inner peripheral wall 12) in the cross section in FIG. 2 may be circular, elliptical, quadrangular or other polygonal.

Although the shapes of the honeycomb structure 10 and the hollow region may be the same as or different from each other, it is preferable that they are the same as each other, in terms of resistance against external impact, thermal stress and the like.

Each of the outer peripheral wall 11 and the inner peripheral wall 12 has a thickness larger than that of the partition wall 13. Such a structure can lead to increased strengths of the outer peripheral wall 11 and the inner peripheral wall 12 which would otherwise tend to generate breakage (e.g., cracking, chinking, and the like) due to external impact, thermal stress caused by a temperature difference between the first fluid and the second fluid, and the like.

The thicknesses of the outer peripheral wall 11, the inner peripheral wall 12 and the partition walls 13 may be appropriately adjusted according to applications and the like. For example, the thickness of each of the outer peripheral wall 11 and the inner peripheral wall 12 is preferably more than 0.3 mm and 10 mm or less when using the heat exchange member 100 and the heat conductive member for general heat exchange applications, and more preferably from 0.5 mm to 5 mm, and even more preferably from 1 mm to 3 mm. Moreover, when using the heat exchange member 100 and the heat conductive member for a thermal storage application, the thickness of the outer peripheral wall 11 is preferably 10 mm or more, in order to increase a heat capacity of the outer peripheral wall 11.

The thickness of the partition wall 13 may preferably be from 0.1 to 1 mm, and more preferably from 0.2 to 0.6 mm. The thickness of the partition wall 13 of 0.1 mm or more can provide the honeycomb structure 10 with a sufficient mechanical strength. Further, the thickness of the partition wall 13 of 1 mm or less can prevent problems that the pressure loss is increased due to a decrease in an opening area and the heat recovery efficiency is decreased due to a decrease in a contact area with the first fluid.

The outer peripheral wall 11, the inner peripheral wall 12 and the partition walls 13 are based on ceramics. The phrase "based on ceramics" means that a ratio of a mass of ceramics to the total mass of the outer peripheral wall 11, the inner peripheral wall 12 and the partition walls 5 is 50% by mass or more.

Each of the outer peripheral wall 11, the inner peripheral wall 12 and the partition walls 13 preferably has a porosity of 10% or less, and more preferably 5% or less, and even more preferably 3% or less. Further, the porosity of the outer peripheral wall 11, the inner peripheral wall 12 and the partition walls 13 may be 0%. The porosity of the outer peripheral wall 11, the inner peripheral wall 12 and the partition walls 13 of 10% or less can lead to improvement of thermal conductivity.

The outer peripheral wall 11, the inner peripheral wall 12 and the partition walls 13 are preferably based on SiC (silicon carbide) having high thermal conductivity. The phrase "based on SiC (silicon carbide)" means that a ratio of a mass of SiC (silicon carbide) to the total mass of the outer peripheral wall 11, the inner peripheral wall 12 and the partition walls 13 is 50% by mass or more.

More particularly, the material of each of the outer peripheral wall 11, the inner peripheral wall 12 and the partition walls 13 that can be used herein includes Si-impregnated SiC, (Si+Al) impregnated SiC, metal composite SiC, recrystallized SiC, $Si_3N_4$, SiC, and the like. Among them, Si—SiC material (sintered body), which based on SiC particles as an aggregate and contains metal Si between the SiC particles, is preferable because it can be produced at low cost and has high thermal conductivity. Specifically, Si-impregnated SiC and (Si+Al) impregnated SiC are preferred as the materials. As used herein, the phrase "based on SiC particles as an aggregate" means that a ratio of SiC particles to the total mass of the aggregate is 50% by mass or more, and preferably 70% by mass or more, and more preferably 80% by mass or more, and even more preferably 95% by mass or more.

A cell density (that is, the number of cells 16 per unit area) in the cross section of the honeycomb structure 10 orthogonal to the flow path direction for the first fluid is not particularly limited. The cell density may be adjusted as needed, and preferably in a range of from 4 to 320 cells/$cm^2$. The cell density of 4 cells/$cm^2$ or more can sufficiently ensure the strength of the partition walls 13, hence the strength of the honeycomb structure 10 itself and effective GSA (geometrical surface area). Further, the cell density of 320 cells/$cm^2$ or less can allow an increase in a pressure loss to be prevented when the first fluid flows.

The honeycomb structure 10 preferably has an isostatic strength of more than 100 MPa or more, and more preferably 200 MPa or more. The isostatic strength of the honeycomb structure 10 of more than 100 MPa or more can lead to the honeycomb structure 10 having improved durability. The isostatic strength of the honeycomb structure 10 can be measured according to the method for measuring isostatic fracture strength as defied in the JASO standard M 505-87 which is a motor vehicle standard issued by Society of Automotive Engineers of Japan, Inc.

A diameter (outer diameter) of the outer peripheral wall 11 in the cross section orthogonal to the flow path direction for the first fluid may preferably be from 20 to 200 mm, and more preferably from 30 to 100 mm. Such a diameter can allow improvement of heat recovery efficiency. If the outer peripheral wall 11 is not circular, the diameter of the largest inscribed circle inscribed in the cross-sectional shape of the outer peripheral wall 11 is defined as the diameter of the outer peripheral wall 11.

Further, a diameter of the inner peripheral wall 12 in the cross section perpendicular to the flow path direction for the first fluid is preferably from 1 to 50 mm, and more preferably from 2 to 30 mm. If the cross-sectional shape of the inner peripheral wall 12 is not circular, the diameter of the largest inscribed circle inscribed in the cross-sectional shape of the inner peripheral wall 12 is defined as the diameter of the inner peripheral wall 12.

The honeycomb structure 10 preferably has a thermal conductivity of 50 W/(m·K) or more at 25° C., and more preferably from 100 to 300 W/(m·K), and even more preferably from 120 to 300 W/(m K). The thermal conductivity of the honeycomb structure 10 in such a range can lead to an improved thermal conductivity and can allow the heat inside the honeycomb structure 10 to be efficiently transmitted to the outside. It should be noted that the value of thermal conductivity is a value measured according to the laser flash method (JIS R 1611-1997).

In the case where an exhaust gas as the first fluid flows through the cells 16 in the honeycomb structure 10, a catalyst may preferably be supported on the partition walls 13 of the honeycomb structure 10. The supporting of the catalyst on the partition walls 13 can allow CO, NOx, HC and the like in the exhaust gas to be converted into harmless substances through catalytic reaction, and can also allow reaction heat generated during the catalytic reaction to be utilized for heat exchange. Preferable catalysts include those containing at least one element selected from the group consisting of noble metals (platinum, rhodium, palladium, ruthenium, indium, silver and gold), aluminum, nickel, zirconium, titanium, cerium, cobalt, manganese, zinc, copper, tin, iron, niobium, magnesium, lanthanum, samarium, bismuth, and barium. Any of the above-listed elements may be contained as a metal simple substance, a metal oxide, or other metal compound.

A supported amount of the catalyst (catalyst metal+support) may preferably be from 10 to 400 g/L. Further, when using the catalyst containing the noble metal(s), the supported amount may preferably be from 0.1 to 5 g/L. The supported amount of the catalyst (catalyst metal+support) of 10 g/L or more can easily achieve catalysis. On the other hand, the supported amount of 400 g/L or less can suppress increases in manufacturing cost and pressure loss. The support refers to a carrier on which the catalyst metal is supported. Examples of the supports include those containing at least one selected from the group consisting of alumina, ceria and zirconia.

The covering member 20 is not particularly limited as long as it can cover the outer peripheral surface of the outer peripheral wall 11 of the honeycomb structure 10. For example, it is possible to use a cylindrical member that is fitted into the outer peripheral surface of the outer peripheral wall 11 of the honeycomb structure 10 to cover circumferentially the outer peripheral wall 11 of the honeycomb structure 10. From the viewpoint of buffering, an inorganic mat or other material may be interposed between the honeycomb structure 10 and the covering member 20.

As used herein, the "fitted" means that the honeycomb structure 10 and the covering member 20 are fixed in a state of being suited to each other. Therefore, the fitting of the honeycomb structure 10 and the covering member 20 encompasses cases where the honeycomb structure 10 and the covering member 20 are fixed to each other by a fixing method based on fitting such as clearance fitting, interference fitting and shrinkage fitting, as well as by brazing, welding, diffusion bonding, or the like.

The covering member 20 can have an inner surface shape corresponding to the outer peripheral wall 11 of the honeycomb structure 10. Since the inner surface of the covering member 20 is in direct contact with the outer peripheral wall 11 of the honeycomb structure 10, the thermal conductivity is improved and the heat in the honeycomb structure 10 can be efficiently transferred to the covering member 20.

In terms of improvement of the heat recovery efficiency, a higher ratio of an area of a portion circumferentially covered with the covering member 20 in the outer peripheral wall 11 of the honeycomb structure 10 to the total area of the outer peripheral wall 11 of the honeycomb structure 10 is preferable. Specifically, the area ratio is preferably 80% or more, and more preferably 90% or more, and even more preferably 100% (that is, the entire outer peripheral surface of the outer peripheral wall 11 of the honeycomb structure 10 is circumferentially covered with the covering member 20).

It should be noted that the term "outer peripheral wall 11" as used herein refers to a surface of the honeycomb structure 10, parallel to the flow path direction for the first fluid, and does not include surfaces (the first end face 14 and the second end face 15) of the honeycomb structure 10, which are orthogonal to the flow path direction for the first fluid.

The covering member 20 is preferably made of a metal in terms of manufacturability. Further, the metallic covering member 20 is also preferable in that it can be easily welded to an outer cylinder (casing) 30 that will be described below. Examples of the material of the covering member 20 that can be used herein include stainless steel, titanium alloys, copper alloys, aluminum alloys, brass and the like. Among them, the stainless steel is preferable because it has high durability and reliability and is inexpensive.

The covering member 20 preferably has a thickness of 0.1 mm or more, and more preferably 0.3 mm or more, and still more preferably 0.5 mm or more, for the reason of durability and reliability. The thickness of the covering member 20 is preferably 10 mm or less, and more preferably 5 mm or less, and still more preferably 3 mm or less, for the reason of reducing thermal resistance and improving thermal conductivity.

A length of the covering member 20 (a length in the flow path direction for the first fluid) is not particularly limited, and it may be adjusted as needed depending on the size of the honeycomb structure 10 or the like. For example, the length of the covering member 20 is preferably larger than the length of the honeycomb structure 10. Specifically, the length of the covering member 20 is preferably from 5 mm to 250 mm, and more preferably from 10 mm to 150 mm, and still more preferably from 20 mm to 100 mm.

It should be noted that when the length of the covering member 20 is larger than the length of the honeycomb structure 10, the covering member 20 is preferably provided such that the honeycomb structure 10 is positioned at the central portion of the covering member 20.

Next, methods for producing the heat exchange member 100 and the heat conductive member will be described. However, the methods for producing the heat exchange member and the heat conductive member are not limited to those described below.

First, a green body containing ceramic powder is extruded into a desired shape to prepare a honeycomb formed body. At this time, the shape and density of the cells 16, the number, lengths and thicknesses of the partition walls 13, the shapes and the thicknesses of the outer peripheral wall 11 and the inner peripheral wall 12, and the like, can be controlled by selecting dies and jig in appropriate forms. The material of the honeycomb formed body that can be used herein includes the ceramics as described above. For example, when producing a honeycomb formed body based on a Si-impregnated SiC composite, a binder and water or an organic solvent are added to a predetermined amount of SiC powder, and the resulting mixture is kneaded to form a green body, which is formed into a honeycomb formed body having a desired shape. The resulting honeycomb formed body can be then dried, and the honeycomb formed body can be impregnated with metallic Si and fired under reduced pressure in an inert gas or vacuum to obtain the honeycomb structure 10 (the heat conductive member).

The honeycomb structure 10 is then shrinkage-fitted into the covering member 20, whereby the outer peripheral surface of the outer peripheral wall 11 of the honeycomb structure 10 is circumferentially covered with the covering member 20. Specifically, the honeycomb structure 10 can be fixed into the covering member 20 by heating and expanding the covering material 20, inserting the honeycomb structure 10 into the covering member 20, and then cooling and shrinking the covering member 20. As described above, the fitting of the honeycomb structure 10 and the covering member 20 can be performed by, in addition to the shrinkage fitting, a fixing method based on fitting such as clearance fitting and interference fitting, or by brazing, welding, diffusion bonding or the like. Thus, the heat exchange member 10 can be obtained.

In the heat exchange member 100 and the heat transfer member according to Embodiment 1 of the present invention, each of the plurality of cells 16 that serve as the flow path for the first fluid is formed from the outer peripheral wall 11, the inner peripheral wall 12, and the partition walls 13 extending in the radial direction, thereby enabling both of improvement of the heat recovery efficiency and suppression of the increase in pressure loss.

(2) Heat Exchanger

The heat exchanger according to Embodiment 1 of the present invention includes the heat exchange member 10 as described above. A member(s) other than the heat exchange member 10 is/are not particularly limited, and a known member(s) may be used. For example, the heat exchanger according to Embodiment 1 of the present invention may include an outer cylinder (casing) at an interval on a radially outer side of the covering member 20 such that a second fluid can flow on the outer periphery of the covering member 20.

Figure 4:
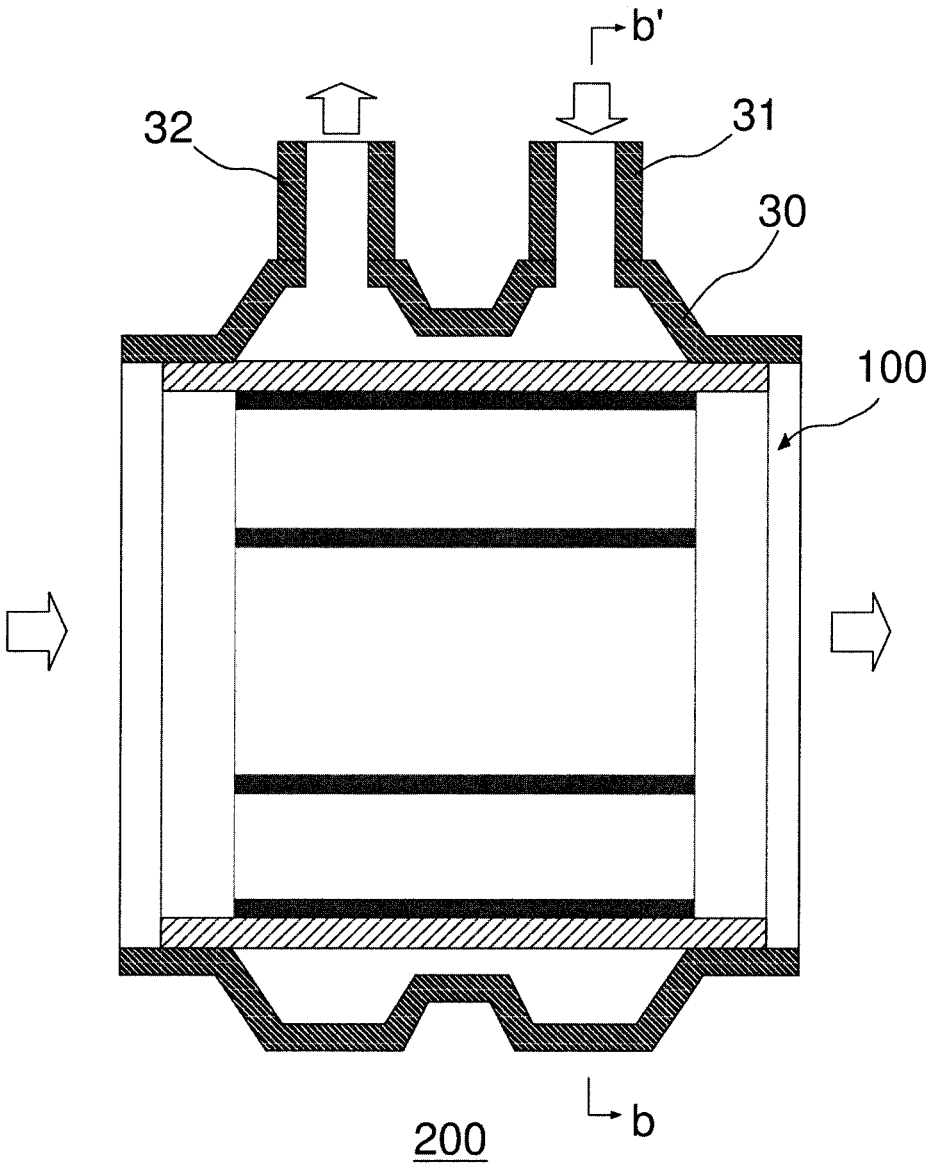
FIG. 4 is a cross-sectional view of a heat exchanger according to Embodiment 1 of the present invention, which is parallel to a flow path direction for a first fluid.
Figure 5:
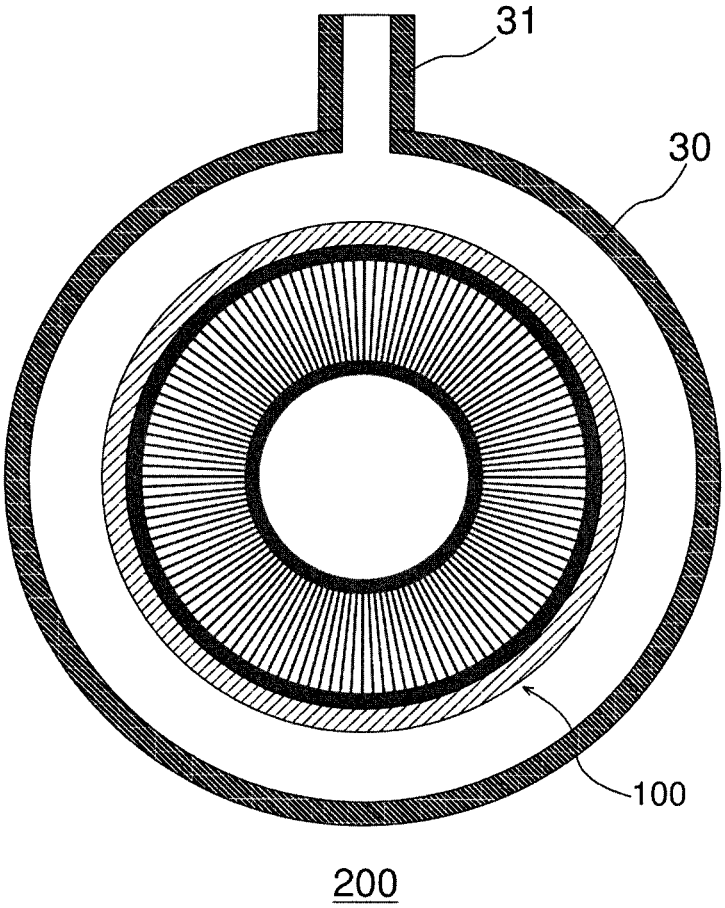
FIG. 5 is a cross-sectional view taken along the line b-b' in the heat exchanger shown in FIG. 4.

FIG. 4 is a cross-sectional view of the heat exchanger according to Embodiment 1 of the present invention, which is parallel to the flow path direction for the first fluid of the honeycomb structure. FIG. 5 is a cross-sectional view taken along the line b-b' in the heat exchanger shown in FIG. 4, that is a cross-sectional view of the heat exchanger according to Embodiment 1 of the present invention, which is orthogonal to the flow path direction for the first fluid of the honeycomb structure.

A heat exchanger 200 according to Embodiment 1 of the present invention includes the heat exchange member 100; and an outer cylinder 30 arranged at an interval on the radially outer side of the covering member 20 such that the second fluid can flow on the outer periphery of the covering member 20 of the heat exchange member 100. The outer cylinder 30 has a feed pipe 31 and a discharge pipe 32 for the second fluid. It is preferable that the outer cylinder 30 circumferentially covers the entire outer periphery of the heat exchange member 100.

In the heat exchanger 200 having the above structure, the second fluid flows into the outer cylinder 30 through the feed pipe 31. Then, while passing through the flow path for the second fluid, the second fluid undergoes heat exchange with the first fluid flowing through the cells 16 of the honeycomb structure 10 via the covering member 20 of the heat exchange member 100, and then flows out from the discharge pipe 32 for the second fluid. It should be noted that the outer peripheral surface of the covering member 20 of the heat exchange member 100 may be covered with a member for adjusting a heat transfer efficiency.

The second fluid is not particularly limited, but the second fluid is preferably water or an anti-freezing solution (LLC defined in JIS K 2234: 2006) when the heat exchanger 200 is mounted on a motor vehicle. For the temperatures of the first fluid and the second fluid, the temperature of the first fluid is preferably higher than that of the second fluid, because under the temperature condition, the covering member 20 of the heat exchange member 100 does not expand at the lower temperature and the honeycomb structure 10 expands at the higher temperature, so that the two fitted members is difficult to be loosened. In particular, when the fitting of the honeycomb structure 10 and the covering member 20 is shrinkage fitting, the above temperature condition can minimize a risk that the fitted members are loosened and the honeycomb structure 10 is fallen out.

Preferably, an inner surface of the outer cylinder 30 is fitted into the outer peripheral surface of the covering member 20 of the heat exchange member 100. This can result in a structure in which the outer peripheral surface of the covering member 20 at both end portions in the flow path direction for the first fluid is circumferentially brought into close contact with the inner surface of the outer cylinder 30, so as to prevent the second fluid from leaking to the outside. A method for bringing the outer peripheral surface of the covering member 20 into close contact with the inner surface of the outer cylinder 30 includes, but not limited to, welding, diffusion bonding, brazing, mechanical fastening, and the like. Among them, the welding is preferable because it has higher durability and reliability and can improve structural strength.

The outer cylinder is preferably made of a metal in terms of thermal conductivity and manufacturability. Examples of the metal that can be used herein include stainless steel, titanium alloys, copper alloys, aluminum alloys, brass, and the like. Among them, the stainless steel is preferable because it is inexpensive and has high durability and reliability.

The outer cylinder 30 preferably has a thickness of 0.1 mm or more, and more preferably 0.5 mm or more, and still more preferably 1 mm or more, for the reasons of durability and reliability. The thickness of the outer cylinder 30 is preferably 10 mm or less, and more preferably 5 mm or less, and still more preferably 3 mm or less, in terms of cost, volume, weight and the like.

The outer cylinder 30 may be an integrally formed product, but it may preferably be a joined member formed of two or more members. In the case where the outer cylinder 30 is the joined member formed of two or more members, freedom in design for the outer cylinder 30 can be improved.

The positions of the feed pipe 31 and the discharge pipe 22 for the second fluid are not particularly limited. The positions may be changed as needed to the axial direction and the outer peripheral direction, in view of the installation position of the heat exchanger 200, the piping position, and the heat exchange efficiency. For example, the feed pipe 31 and the discharge pipe 32 for the second fluid can be provided at positions corresponding to the axial ends of the honeycomb structure 10. The feed pipe 31 and the discharge pipe 32 for the second fluid may extend toward the same direction or toward different directions.

The heat exchanger 200 according to Embodiment 1 of the present invention can further include an inner cylinder in a hollow portion of the honeycomb structure 10 (on the inner side of the inner peripheral wall 12) and an on-off valve provided in the inner cylinder.

The inner cylinder can have through holes for introducing the first fluid into the cells 16 of the honeycomb structure 10, and the through holes can branch the flow of the first fluid into two flows (the cell 16 and the hollow portion of the honeycomb structure 10).

The on-off valve can control an amount of the first fluid flowing through the hollow portion of the honeycomb structure 10 by its opening/closing mechanism. In particular, the on-off valve can selectively introduce the first fluid into the cells 16 of the honeycomb structure 10 through the through holes by blocking the flow of the first fluid inside the inner cylinder during heat exchange between the first fluid and the second fluid.

The through holes provided in the inner cylinder may be formed around the entire circumference of the inner cylinder or at a partial position (e.g., only at the upper, center or lower position) of the inner cylinder. The through holes may have various shapes, such as circular, oval, and quadrangular shapes.

In the heat exchanger 200 having such a structure, the first fluid can be circulated inside the inner cylinder. When the on-off valve is closed, the ventilation resistance inside the inner cylinder increases, and the first fluid selectively flows into the cells 16 through the through holes. On the other hand, when the on-off valve is open, the ventilation resistance inside the inner cylinder decreases, and the first fluid selectively flows into the inner cylinder inside the hollow portion. Therefore, the controlling of the opening and closing of the on-off valve can adjust the amount of the first fluid flowing into the cells 16. Since the first fluid flowing through the inner cylinder in the hollow portion hardly contributes to the heat exchange with the second fluid, this flow path for the first fluid functions as a bypass route in a case where the heat recovery of the first fluid is desired to be suppressed. In other words, if it is desired to suppress the heat recovery of the first fluid, the on-off valve may be opened.

Next, the method for producing the heat exchanger 200 will be described. However, the method for producing the heat exchanger 200 is not limited to the production method as described below.

The heat exchanger 200 can be producing by arranging the outer cylinder 30 at an interval on the radially outer side of the covering member 20 of the heat exchanger 100 and joining them such that the second fluid can circulate around the outer periphery of the covering member 20. Specifically, both ends of the covering member 20 of the heat exchange member 100 are joined to the inner surface of the outer cylinder 30. There are various joining methods, including fitting, as described above. If necessary, the joining points can be joined by welding or the like. As a result, the outer cylinder 30 is formed to circumferentially cover the outer periphery of the coating member 20, and the flow path for the second fluid is formed between the outer peripheral surface of the covering member 20 and the inner surface of the outer cylinder 30. The heat exchanger 200 can be thus obtained.

When the inner cylinder and the on-off valve are further provided, the inner cylinder having the on-off valve can be inserted into the inner peripheral wall 12 of the honeycomb structure and fitted by shrinkage fitting. The fitting of the inner cylinder into the inner peripheral wall 12 of the honeycomb structure 10 can be carried out by, in addition to the shrinkage fitting, fixing method based on fitting such clearance fitting, and interference fitting, as well as by brazing, welding, diffusion bonding, or the like, as described above.

Since the heat exchanger 200 according to Embodiment 1 of the present invention includes the heat exchanger member 100 as described above, it is possible to achieve both improvement of the heat recovery efficiency and suppression of the increase in pressure loss.

Embodiment 2

(1) Heat Exchange Member and Heat Conductive Member

Figure 6:
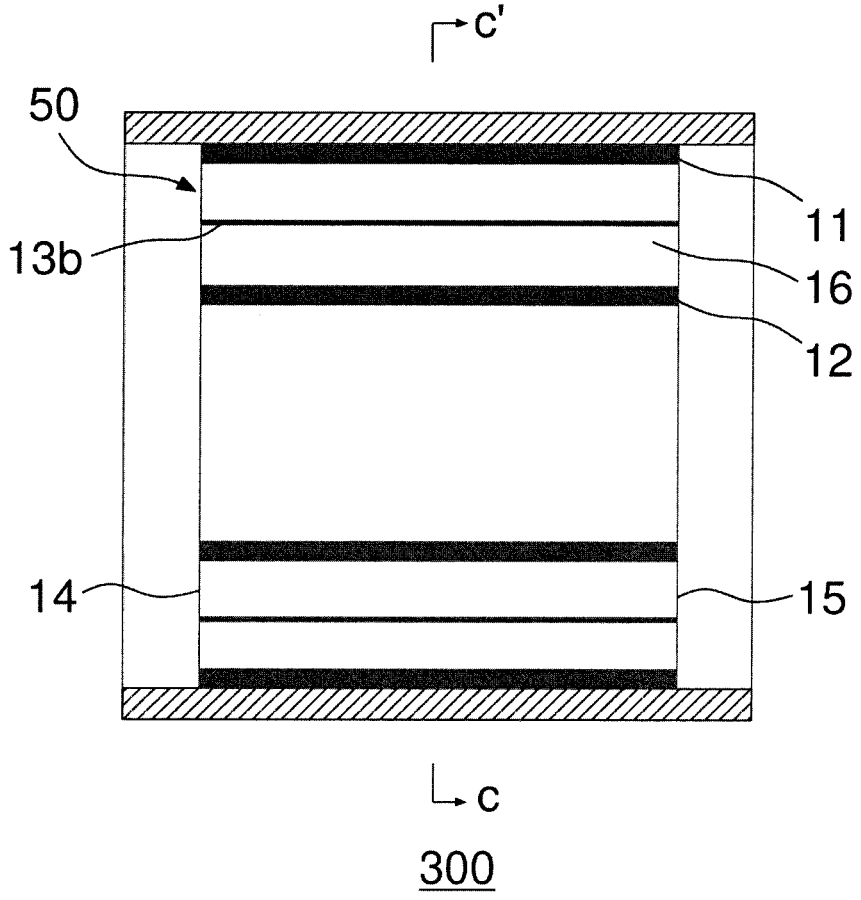
FIG. 6 is a cross-sectional view of a heat exchange member according to Embodiment 2 of the present invention, which is parallel to an axial direction of a honeycomb structure.
Figure 7:
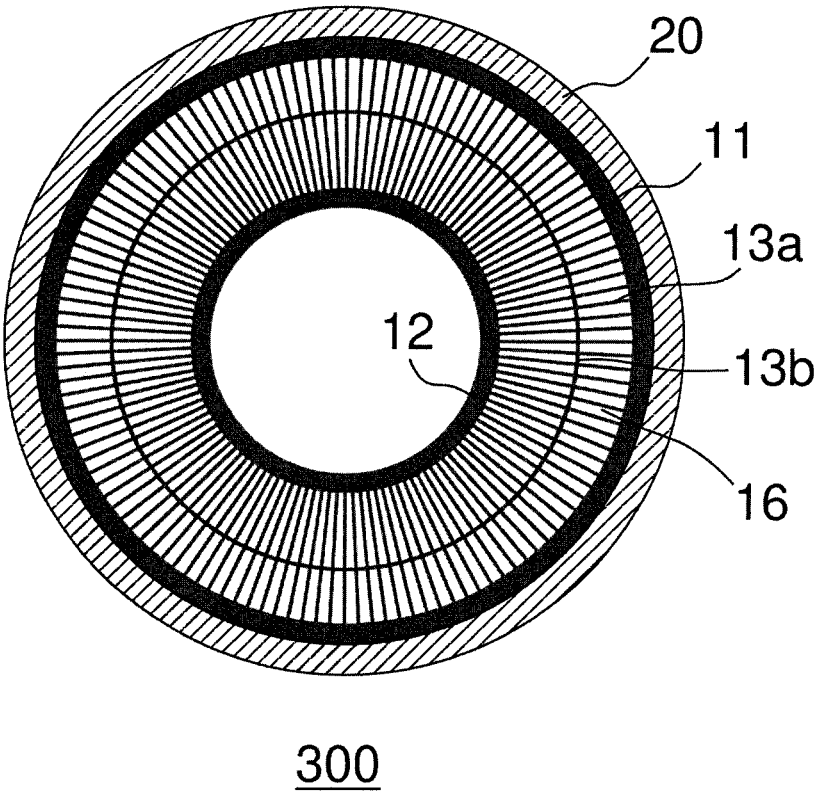
FIG. 7 is a cross-sectional view taken along the line c-c' in the heat exchange member shown in FIG. 6.
Figure 8:
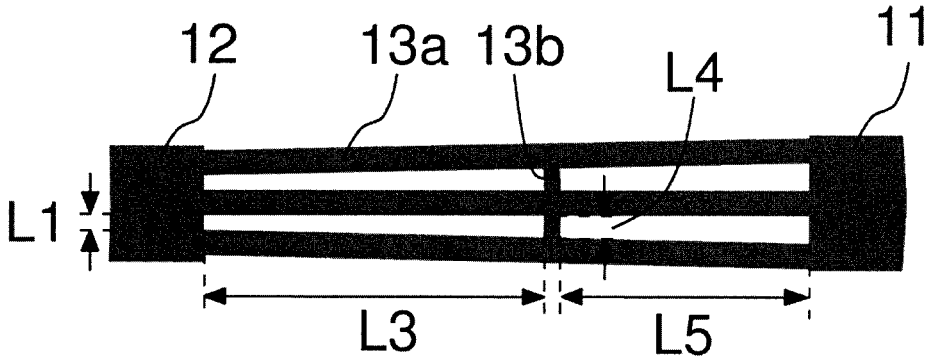
FIG. 8 is a partially enlarged view of a honeycomb structure forming the heat exchange member shown in FIG. 7.

FIG. 6 is a cross-sectional view of a heat exchange member according to Embodiment 2 of the present invention, which is parallel to an axial direction of the honeycomb structure. FIG. 7 is a cross-sectional view taken along the line c-c' in the heat exchange member shown in FIG. 6, that is, a cross-sectional view of the heat exchange member according to Embodiment 2 of the present invention, which is orthogonal to the flow path direction (axial direction) for the first fluid of the honeycomb structure. FIG. 8 is a partially enlarged view of a honeycomb structure forming the heat exchange member shown in FIG. 7.

In FIGS. 6 and 7, the components indicated by the same reference numerals as in FIGS. 1 and 2 show the same components. Therefore, detailed descriptions of the same components will be omitted.

A heat exchange member 300 according to Embodiment 2 of the present invention includes: a honeycomb structure 50 including: an outer peripheral wall 11; an inner peripheral wall 12; and partition walls 13 arranged between the outer peripheral wall 11 and the inner peripheral wall 12, the partition walls 13 defining a plurality of cells 16 each extending from a first end face 14 to a second end face 15 to form a flow path for a first fluid; and a covering member 20 for covering an outer peripheral surface of the outer peripheral wall 11.

The partition walls 13 include partition walls 13*a* that extend in the radial direction in the cross section of the honeycomb structure 50 orthogonal to the flow path direction for the first fluid (i.e., the cross section shown in FIG. 7). The partition walls 13 may further include partition walls 13*b* extending in the circumferential direction. The partition walls 13*b* extending in the circumferential direction do not contribute so much to the heat exchange between the first fluid and the second fluid as described above, and are also a factor for increasing the pressure loss. However, the provision of the partition walls 13*b* in a range that does not interfere with both improvement of the heat recovery efficiency and suppression of the increase in the pressure loss can ensure the mechanical strength of the honeycomb structure 10.

Among members of the heat exchange member 300 according to Embodiment 2 of the present invention, the member excluding the covering member 20 is referred to as a heat conductive member. In other words, the heat conductive member according to Embodiment 2 of the present invention has the honeycomb structure 50 including: the outer peripheral wall 11; the inner peripheral wall 12; and the partition walls 13 arranged between the outer peripheral wall 11 and the inner peripheral wall 12, the partition walls 13 defining the plurality of cells 16 each extending from the first end face 14 to the second end face 15 to form the flow path for the first fluid.

In the cross section of the honeycomb structure 50 orthogonal to the flow path direction for the first fluid, the heat exchange member 300 and the heat conductive member according to Embodiment 2 of the present invention has a ratio (N/D1) of the number (N) of the partition walls 13*a* extending in the radial direction to an outer diameter D1 (mm) of the honeycomb structure 50 of 3.2 partition walls/mm or more, and more preferably 4 partition walls/mm or more. This configuration facilitates both improvement of heat recovery efficiency and suppression of increase in pressure loss, even if it has the partition walls 13*b* extending in the circumferential direction.

In the cross section of the honeycomb structure 50 orthogonal to the flow path direction for the first fluid, an aspect ratio of each cell 16 may preferably be 3 or more, and more preferably 5 or more, although not particularly limited. The controlling of the aspect ratio in such a range can stably achieve both improvement of heat recovery efficiency and suppression of increase in pressure loss.

As used herein, the aspect ratio of each cell 16 refers to a ratio of a length L3 of the partition wall 13*a* extending in the radial direction to a length L1 of the inner peripheral wall 12, and a ratio of a length L5 of the partition wall 13*a* extending in the radial direction to a length L4 of the partition wall 13*b* extending in the circumferential direction, which form one cell 16.

The upper limit of the aspect ratio of each cell 16 may generally be 50 or less, although not particularly limited thereto.

In a typical embodiment, the number of the partition walls 13*a* extending in the radial direction is from 200 to 500, and preferably from 300 to 500. The length L3, L5 of the partition wall 13*a* extending in the radial direction, which forms one cell, is from 0.85 to 10 mm. Further, each of the length L1 of the inner peripheral wall 12 and the length L4 of the partition wall 13*b* extending in the circumferential direction, which form one cell 16, is from 0.1 to 2 mm. Such a structure can achieve both improvement of the heat recovery efficiency and suppression of the increase in pressure loss.

When the partition walls 13 include both the partition walls 13*a* extending in the radial direction and the partition walls 13*b* extending in the circumferential direction, the thickness of each partition wall 13*a* extending in the radial direction is preferably higher than that of each partition wall 13*b* extending in the circumferential direction. Since the thickness of the partition wall 13 correlates with the thermal conductivity, the above structure can allow the thermal conductivity of the partition walls 13*a* extending in the radial direction to be higher than that of the partition walls 13*b* extending in the circumferential direction. As a result, the heat of the first fluid passing through the cells 16 can be efficiently transferred to the outside of the honeycomb structure 50.

It should be noted that the thicknesses of the partition walls 13 (the partition walls 13*a* extending in the radial direction and the partition walls 13*b* extending in the circumferential direction) are not particularly limited, and they may be appropriately adjusted depending on applications or the like. The thickness of the partition wall 13 may preferably be from 0.1 to 1 mm, and more preferably from 0.2 to 0.6 mm. The thickness of the partition wall 13 of 0.1 mm or more can provide the honeycomb structure 50 with a sufficient mechanical strength. Further, the thickness of the partition wall 13 of 1 mm or less can prevent problems that the pressure loss is increased due to a decrease in an opening area and the heat recovery efficiency is decreased due to a decrease in a contact area with the first fluid.

The heat exchange member 300 and the heat conductive member according to Embodiment 2 of the present invention control the ratio (N/D1) of the number N of partition walls 13*a* extending in the radial direction to the outer diameter D1 (mm) of the honeycomb structure 50, so that both improvement of heat recovery efficiency and suppression of increase in pressure loss can be achieved.

(2) Heat Exchanger

The heat exchanger according to Embodiment 2 of the present invention includes the heat exchange member 300 as described above. A member(s) other than the heat exchange member 300 is/are not particularly limited, and a known member(s) may be used. For example, the heat exchanger according to Embodiment 2 of the present invention may include: the heat exchange member 300; and an outer cylinder (casing) at an interval on a radially outer side of the covering member 20 such that a second fluid can flow on the outer periphery of the covering member 20 of the heat exchange member 300.

The heat exchanger according to Embodiment 2 of the present invention is the same as that in FIGS. 4 and 5, with the exception that it has the heat exchanger member 300 as described above, so a detailed description thereof will be omitted.

Since the heat exchanger according to Embodiment 2 of the present invention includes the heat exchanger member 300 as described above, it is possible to achieve both improvement of the heat recovery efficiency and suppression of the increase in pressure loss.

Examples

Hereinafter, the present invention will be described in more detail with reference to Examples, but the present invention is not limited to these Examples.

A green body containing SiC powder was extruded into a desired shape, dried, processed to have predetermined external dimensions, and impregnated with Si and fired to produce hollow-type honeycomb structures (cylindrical shape) each having a hollow portion, comprised of a Si—SiC material (si-impregnated SiC) containing a metal Si between SiC particles and having a circular cross section orthogonal to the axial direction. Each of the produced honeycomb structures set: the diameter (outer diameter) D1 of the outer peripheral wall 11 to 75 mm; the diameter of the inner peripheral wall 12 to 57 mm; the length in the axial direction (flow path direction for the first fluid) to 15 mm; the thickness of each of the outer peripheral wall 11 and the inner peripheral wall 12 to 1 mm; the thickness of each of the partition walls 13*a*, 13*b* to 0.3 mm; and the thermal conductivity (25° C.) to 150 W/(m·K). Other features and the like are shown in Table 1.

Each of the honeycomb structures obtained in the above Examples and Comparative Examples was then subjected to shrinkage fitting into the covering member to produce a heat exchange member. As the covering member, a stainless steel tubular member (having a thickness of 1 mm) was used. Each heat exchange member was then arranged in the outer cylinder (casing: a thickness of 1.5 mm) and both ends of the heat exchange member (covering member) were joined to the outer cylinder to produce a heat exchanger having the structure as shown in FIGS. 4 and 5.

The produced heat exchangers were evaluated as follows:

<Heat Exchanging Test>

The heat exchangers thus produced were subjected to a heat exchanging test by the following method. Air (the first fluid) having a temperature (Tg1) of 400° C. flowed through each of the honeycomb structures at a flow rate (Mg) of 10 g/s. On the other hand, cooling water (the second fluid) at 40° C. was fed from the feed pipe for the second fluid at a flow rate (Mw) of 10 L/min, and the cooling water after heat exchange was recovered from the discharge pipe for the second fluid.

Immediately after passing air and cooling water through each heat exchanger for 5 minutes from the start of feed under the above conditions, a temperature (Tw1) of the cooling water at the inlet for the second fluid and a temperature (Tw2) of the cooling water at the outlet for the second fluid were measured to determine a recovered heat quantity Q:

$$Q\ (\mathrm{kW}) = \Delta T\ [K] \times Cpw\ [J/(\mathrm{kg}\cdot\mathrm{K})] \times Pw\ [\mathrm{kg/m^3}] \times Mw\ [\mathrm{L/min}]/(60\times10^6),\ \text{with:}$$

$\Delta Tw = Tw2 - Tw1$, and Cpw (specific heat of water)=4182 J/(kg·K), and Pw (water density)=997 kg/m$^3$.

<Pressure Loss Test>

In the above heat exchanging test, pressure gauges were disposed in the flow path for air located in front and behind of each heat exchange member, respectively. The pressure loss of the air flowing through each heat exchange member (through the cells) was measured from a differential pressure obtained from the measurement values for those pressure gauges.

TABLE 1

| | Example 1 | Example 2 | Example 3 | Comparative Example 1 | Comparative Example 2 |
|---|---|---|---|---|---|
| Number N of Partition Walls 13a | 200 | 300 | 400 | 150 | 200 |
| Number of Partition Walls 13b | 0 | 0 | 0 | 2 | 2 |
| Outer Diameter D1 (mm) of Outer Peripheral Wall 11 | 75 | 75 | 75 | 75 | 75 |
| N/D1 (partition walls/mm) | 2.6 | 4.0 | 5.3 | 2.0 | 2.6 |
| Length of Inner Peripheral Wall 12 Forming One Cell 16 Lx1 (mm) | 0.63 | 0.32 | 0.16 | 0.94 | 0.63 |
| Length of Partition Wall 13b Forming One Cell 16 Lx2, Lx3 (mm) <Note 1> | — | — | — | (Lx2) 1.04<br>(Lx3) 1.14 | (Lx2) 0.70<br>(Lx3) 0.78 |
| Length Ly (mm) of Partition Wall 13a Forming One Cell 16 <Note 2> | 7 | 7 | 7 | 2.1 | 2.1 |
| Aspect Ratio <Note 3> | 11 | 21 | 43 | (Asp1) 2.2<br>(Asp2) 2.0<br>(Asp3) 1.8 | (Asp1) 3.3<br>(Asp2) 3.0<br>(Asp3) 2.7 |
| Recovered Heat Quantity (kW) | 1900 | 2200 | 2500 | 1700 | 1800 |
| Pressure Loss (Pa) | 300 | 500 | 600 | 250 | 320 |

(Remarks)

<Note 1>:

(Lx2) is the length of the first partition wall 13b from the inner peripheral wall 12 side, and (Lx3) is the length of the second partition wall 13b from the inner peripheral wall 12 side.

<Note 2>:

In Comparative Examples 1 and 2, the lengths of the partition walls 13a forming each cell are the same.

<Note 3>:

(Asp1) is a value of Ly/Lx1, (Asp2) is a value of Ly/Lx2, and (Asp3) is a value of Ly/Lx3.

As shown in Table 1, each of Examples 1 to 3 had a higher recovered heat quantity than that of each of Comparative Examples 1 and 2. The recovered heat quantity depends on the number of the partition walls 13*a* extending in the radial direction, and the recovered heat quantity tends to increase as the number of the partition walls 13*a* increases. Even if Example 1 is compared with Comparative Example 2, which have the same number of the partition walls 13*a*, the recovered heat quantity in Example 1 was higher.

Further, the pressure loss also depends on the number of the partition walls 13*a* extending in the radial direction, and the pressure loss increases as the number of the partition walls 13*a* increases. However, when Example 1 is compared with Comparative Example 2, which have the same number of the partition walls 13*a*, the pressure loss in Example 1 was lower.

As can be seen from the above results, according to the present invention, it is possible to provide a heat exchange member and a heat exchanger which can achieve both an increase in a heat recovery efficiency and suppression of an increase in pressure loss. Also, according to the present invention, it is possible to provide a heat conductive member that can be mounted on the heat exchange member and the heat exchanger as described above.

DESCRIPTION OF REFERENCE NUMERALS

10,50 honeycomb structure
11 outer peripheral wall
12 inner peripheral wall
13 partition wall
13*a* partition wall extending in radial direction
13*b* partition wall extending in circumferential direction
14 first end face
15 second end face
16 cell
20 covering member
30 outer cylinder
31 feed pipe
32 discharge pipe
100,300 heat exchange member
200 heat exchanger

The invention claimed is:

1. A heat exchange member, comprising:

a honeycomb structure comprising: an outer peripheral wall; an inner peripheral wall; and partition walls arranged between the outer peripheral wall and the inner peripheral wall, the partition walls defining a plurality of cells, each of the cells extending from a first end face to a second end face to form a flow path for a first fluid; and a covering member for covering an outer peripheral surface of the outer peripheral wall, wherein in a cross section of the honeycomb structure orthogonal to a flow path direction for the first fluid, the partition walls extend in a radial direction, wherein each of the cells is formed from the outer peripheral wall, the inner peripheral wall, and the partition walls, and wherein, in the cross section of the honeycomb structure orthogonal to the flow path direction for the first fluid, a ratio of the number of the partition walls to an outer diameter (mm) of the honeycomb structure is 2.3 partition walls/mm or more.

2. The heat exchange member according to claim 1, wherein the ratio of the number of the partition walls to the outer diameter (mm) of the honeycomb structure is 3.2 partition walls/mm or more.

3. The heat exchange member according to claim 1, wherein, in the cross section of the honeycomb structure orthogonal to the flow path direction for the first fluid, an aspect ratio of each of the cells is 3 or more.

4. A heat exchanger, comprising:

the heat exchange member according to claim 1; and an outer cylinder arranged at an interval on a radially outer side of the covering member so that a second fluid can circulate around an outer periphery of the covering member.

5. A heat exchange member, comprising:

a honeycomb structure comprising: an outer peripheral wall; an inner peripheral wall; and partition walls arranged between the outer peripheral wall and the inner peripheral wall, the partition walls defining a plurality of cells, each of the cells extending from a first end face to a second end face to form a flow path for a first fluid; and a covering member for covering an outer peripheral surface of the outer peripheral wall, wherein in a cross section of the honeycomb structure orthogonal to a flow path direction for the first fluid, the partition walls comprise partition walls extending in a radial direction, and a ratio of the number of partition walls extending in the radial direction to an outer diameter (mm) of the honeycomb structure is 3.2 partition walls/mm or more.

6. The heat exchange member according to claim 5, wherein an aspect ratio of each of the cells is 3 or more.

7. A heat conductive member, comprising a honeycomb structure comprising: an outer peripheral wall; an inner peripheral wall; and partition walls arranged between the outer peripheral wall and the inner peripheral wall, the partition walls defining a plurality of cells, each of the cells extending from a first end face to a second end face to form a flow path for a first fluid, wherein the outer peripheral wall, the inner peripheral wall, and the partition walls comprise a Si—SiC material based on SiC particles as an aggregate, wherein a metal Si is contained between the SiC particles, wherein in a cross section of the honeycomb structure orthogonal to a flow path direction for the first fluid, the partition walls extend in a radial direction, wherein each of the cells is formed from the outer peripheral wall, the inner peripheral wall, and the partition walls, and wherein, in the cross section of the honeycomb structure orthogonal to the flow path directionfor the first fluid, a ratio of the number of the partition walls to an outer diameter (mm) of the honeycomb structure is 2.3 partition walls/mm or more.

8. The heat conductive member according to claim 7, wherein, in the cross section of the honeycomb structure orthogonal to the flow path direction for the first fluid, an aspect ratio of each of the cells is 3 or more.

9. A heat conductive member, comprising a honeycomb structure comprising: an outer peripheral wall; an inner peripheral wall; and partition walls arranged between the outer peripheral wall and the inner peripheral wall, the partition walls defining a plurality of cells, each of the cells extending from a first end face to a second end face to form a flow path for a first fluid, wherein the outer peripheral wall, the inner peripheral wall, and the partition walls comprise a Si—SiC material based on SiC particles as an aggregate, wherein a metal Si is contained between the SiC particles, and wherein in a cross section of the honeycomb structure orthogonal to a flow path direction for the first fluid, the partition walls comprise partition walls extending in a radial direction, and a ratio of the number of partition walls extending in the radial direction to an outer diameter (mm) of the honeycomb structure is 3.2 partition walls/mm or more.

* * * * *